US007357566B2

(12) United States Patent
Kozyuk

(10) Patent No.: US 7,357,566 B2
(45) **Date of Patent: *Apr. 15, 2008**

(54) DEVICE AND METHOD FOR CREATING VORTEX CAVITATION IN FLUIDS

(75) Inventor: Oleg V. Kozyuk, North Ridgeville, OH (US)

(73) Assignee: Five Star Technologies, Inc., Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/675,804

(22) Filed: Feb. 16, 2007

(65) Prior Publication Data

US 2007/0140052 A1 Jun. 21, 2007

Related U.S. Application Data

(63) Continuation of application No. 10/830,536, filed on Apr. 23, 2004, now Pat. No. 7,178,975.

(51) Int. Cl.
*B01F 5/08* (2006.01)

(52) U.S. Cl. ..... 366/165.4; 366/264

(58) Field of Classification Search ..... 366/165.1, 366/165.4, 263–265, 316; 137/812, 813
See application file for complete search history.

(56) References Cited

U.S. PATENT DOCUMENTS

| | | | | |
|---|---|---|---|---|
| 780,260 | A | 1/1905 | Beemer | |
| 2,043,108 | A | 6/1936 | Maurer | |
| 2,081,955 | A | 6/1937 | Randel | |
| 2,598,187 | A | 5/1952 | Meyer | |
| 2,738,930 | A | 3/1956 | Schneider | |
| 2,969,960 | A | 1/1961 | Gurley, Jr. | |
| 3,690,621 | A | 9/1972 | Tanaka et al. | |
| 3,907,456 | A | 9/1975 | Krienke | |
| 4,201,487 | A | 5/1980 | Backhaus | |
| 4,361,414 | A | 11/1982 | Nemes | |
| 5,188,090 | A | 2/1993 | Griggs | |
| 5,263,774 | A | 11/1993 | Delcourt | |
| 5,522,553 | A | 6/1996 | LeClair et al. | |
| 5,590,961 | A | 1/1997 | Rausmussen | |
| 5,782,556 | A | 7/1998 | Chu | |
| 5,810,052 | A | 9/1998 | Kozyuk | |
| 5,937,906 | A | 8/1999 | Kozyuk | |
| 5,957,122 | A | 9/1999 | Griggs | |
| 6,000,840 | A | 12/1999 | Paterson | |
| 6,019,947 | A | 2/2000 | Kucherov | |
| 6,241,472 | B1 | 6/2001 | Bosch et al. | |
| 6,382,185 | B1 * | 5/2002 | Mennicken et al. | 123/467 |
| 6,386,751 | B1 | 5/2002 | Wootan et al. | |
| 6,402,065 | B1 | 6/2002 | Higgins | |

(Continued)

*Primary Examiner*—David Sorkin
(74) *Attorney, Agent, or Firm*—Benesch, Friedlander, Coplan & Aronoff LLP

(57) ABSTRACT

Devices for mixing and/or reacting combinations of one or more liquids, gases or solids is provided. The device can generally have at least one cavity into which a fluid flows by way of a tangential orifice, thereby forming cavitation bubbles. The cavity is configured to alternate between a closed position, where pressure increases in the fluid and the cavitation bubbles collapse, and an open position, where the fluid exits the cavity. Also provided are methods for mixing and/or reacting fluids. Also provided are mixture and reaction products made using the methods.

9 Claims, 12 Drawing Sheets

U.S. PATENT DOCUMENTS 6,502,979 B1 1/2003 Kozyuk
6,589,501 B2 7/2003 Moser et al.
6,627,784 B2 9/2003 Hudson et al.
6,857,774 B2 2/2005 Kozyuk
7,178,975 B2 * 2/2007 Kozyuk ..... 366/165.4

* cited by examiner

DEVICE AND METHOD FOR CREATING VORTEX CAVITATION IN FLUIDS

CROSS-REFERENCE TO RELATED APPLICATION

This application is a continuation of U.S. application Ser. No. 10/830,536 filed on Apr. 23, 2004, which is now U.S. Pat. No. 7,178,975.

BACKGROUND

Cavitation is related to formation of bubbles and cavities within a liquid. Bubble formation may result from a localized pressure drop in the liquid. For example, if the local pressure of a liquid decreases below its boiling point, vapor-filled cavities and bubbles may form. As the pressure then increases, vapor condensation may occur in the bubbles and they may collapse, creating large pressure impulses and high temperatures. When cavitation is used for mixing of substances, the process may be called high-shear mixing.

There may be several different methods to produce cavitation bubbles in a liquid. One method may be to rotate a propeller blade in or through the liquid. If a sufficient pressure drop occurs at the blade surface, cavitation bubbles may result. Another method may be to move a fluid through a restriction, such as an orifice plate. If a sufficient pressure drop occurs across the orifice, cavitation bubbles may result. Cavitation bubbles may also be generated in a liquid using ultrasound.

The impulses and high temperatures produced by collapse of cavitation bubbles may be used for various mixing, emulsifying, homogenizing and dispersing processes, and also to initiate and/or facilitate a variety of chemical reactions. Devices and methods designed to produce cavitation in liquids, however, may not sufficiently control either the rate of formation of cavitation bubbles, the collapse of cavitation bubbles, or the location at which they are formed. For example, uncontrolled cavitation in a chemical reaction may result in pressures and/or temperatures that could damage chemical reactants or products. In another example, formation of cavitation bubbles along the surface walls of a cavitation device could cause premature erosion of the surface.

BRIEF DESCRIPTION OF THE DRAWINGS

In the accompanying drawings, which are incorporated in and constitute a part of the specification, embodiments of a device and method are illustrated which, together with the detailed description given below, serve to describe the example embodiments of the device, methods and so on. The drawings are for the purposes of illustrating the preferred and alternate embodiments and are not to be construed as limitations.

Further, in the accompanying drawings and description that follow, like parts or components are indicated throughout the drawings and description with the same reference numerals, respectively. The figures are not necessarily drawn to scale and the proportions of certain parts or components have been exaggerated for convenience of illustration.

DETAILED DESCRIPTION OF ILLUSTRATED EMBODIMENTS

This application describes devices and methods related to providing controlled formation and collapse of cavitation bubbles in a fluid. The devices and methods generally provide for introduction of a fluid into a cavity and formation of cavitation bubbles therein. A vortex may also be formed in the cavity. Generally, the cavity is configured to alternate between at least two positions. In one position, referred to as a "closed position," pressure in the cavity increases and the cavitation bubbles therein can collapse. In another position, referred to as an "open position," at least some of the fluid can exit the cavity.

Figure 1:
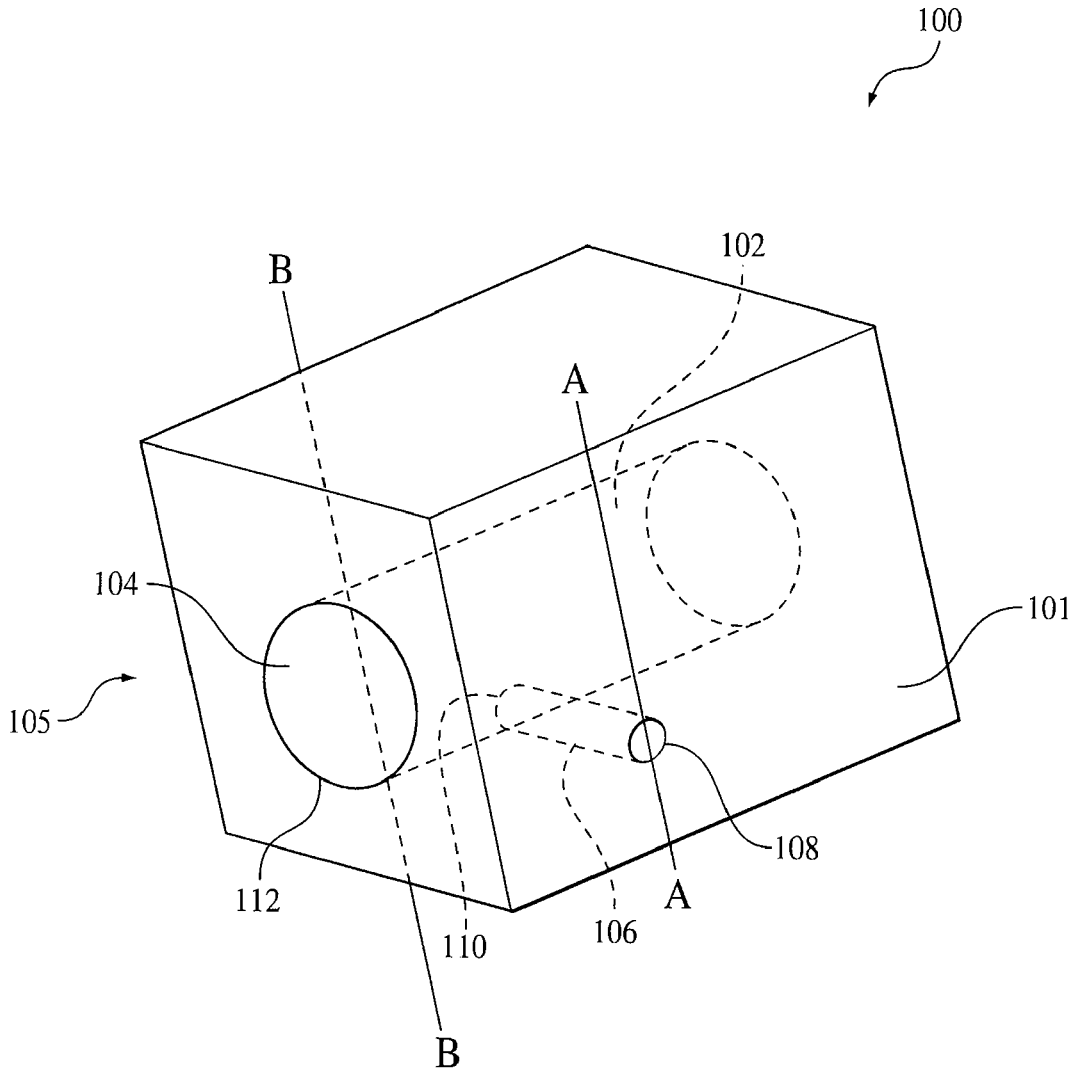
FIG. 1 is a perspective view of one embodiment of a mixing device 100.

FIG. 1 is a perspective view of one embodiment of a mixing device 100. The mixing device 100 can include a housing 101 and a cavity 102 disposed in the housing 101. In the embodiment shown, the cavity 102 is cylindrical in shape, but other shapes are possible. The cavity 102 is defined by at least one wall 104, but more than one wall 104 may be present. Generally, the wall or walls 104 of the cavity 102 define the shape of the cavity 102.

In one embodiment, there are at least two openings by which the cavity 102 is in fluid communication with the outside or exterior 105 of the mixing device 100. One such opening is a tangential opening 106, which can also be referred to herein as a tangential orifice or tangential passageway. The tangential opening 106 may be disposed within the mixing device 100, as shown in FIG. 1. The tangential opening may have a first end 108 through which the fluid enters, and a second end 110 though which the fluid flows into the cavity 102.

Generally, a force or forces causes flow of the fluid to enter the first end 108 of the tangential opening 106 and exit the second end 110 of the tangential opening 102 to thereby enter the cavity 102. In one embodiment, the fluid can be pumped into and through the tangential opening 106 and into the cavity 102. For example, a mechanical pump may provide such a force. In other embodiments, movement of the mixing device 100 may provide forces for pumping the fluid into the tangential opening 106. For example, the mixing device 100 may be rotated such that a centrifugal force is created which forces the fluid into the tangential opening 106.

In the embodiment illustrated in FIG. 1, the tangential opening 106 is shaped as a cylinder. Obviously, other shapes are possible. The width of the tangential opening 106 (i.e., the diameter, if the tangential opening 106 is shaped as a cylinder) is such that it provides for formation of cavitation bubbles as or after the fluid flows through the tangential opening 106 and into the cavity 102. In one example, the width of the tangential opening 106 is dimensioned such that it provides for a pressure drop in the fluid at some point during the flow of the fluid through the tangential opening 106 and into the cavity 102, such that cavitation bubbles are formed. The pressure drop may occur at or near the point where the tangential opening 106 enters into the cavity 102 (e.g., at or near the second end 110 of the tangential opening 106).

A second opening by which the cavity 102 can be in fluid communication with the outside or exterior 105 of the mixing device 100 is an exit opening 112. In one embodiment, the exit opening 112 is an opening by which fluid that enters into the cavity 102 via the tangential opening 106 can exit the cavity 102. In the embodiment illustrated in FIG. 1, the exit opening 112 is an open end of the cylinder-shaped cavity 102.

Figure 2:
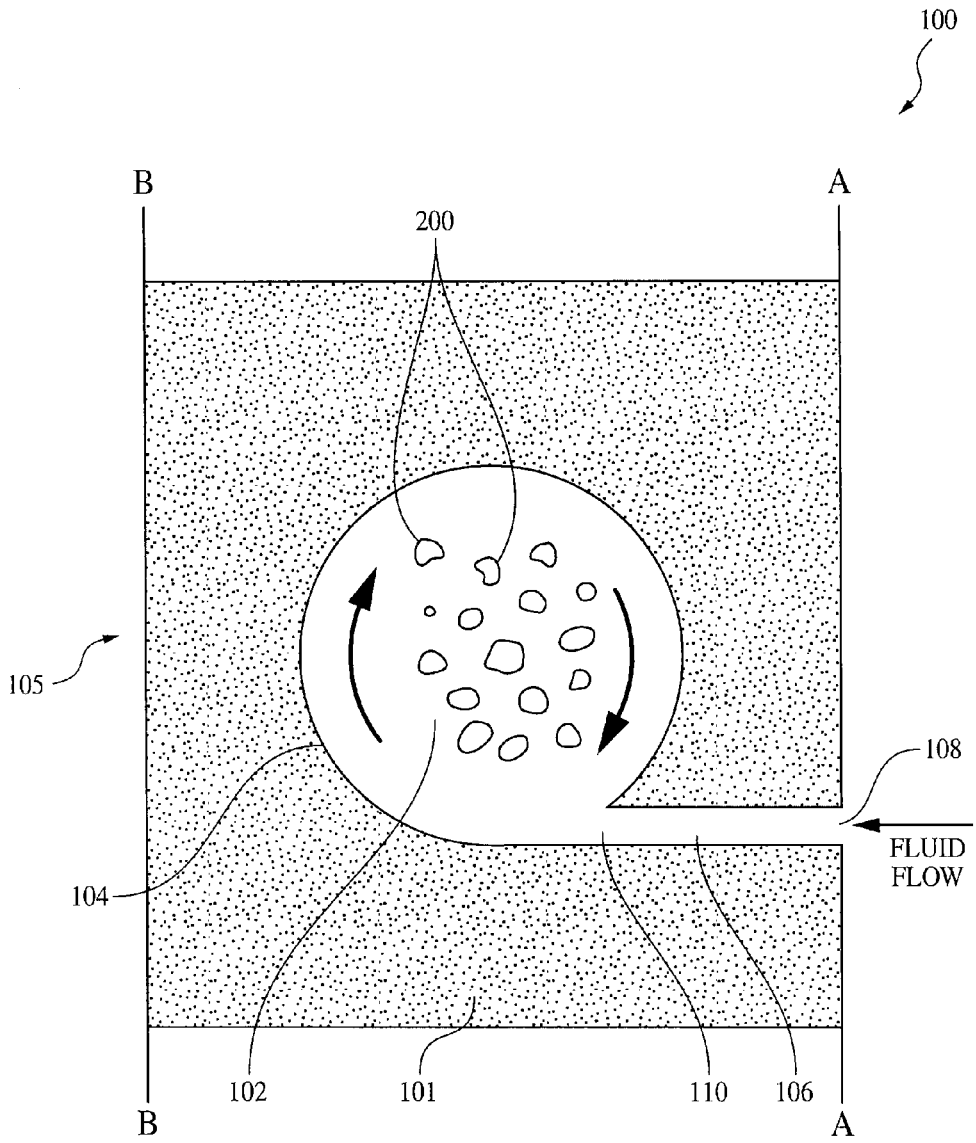
FIG. 2 is a cross-sectional view of the embodiment of the mixing device 100 shown in FIG. 1, along the plane defined by parallel lines A-A and B-B in FIG. 1.

FIG. 2 is a cross-sectional view of the embodiment of the mixing device 100 shown in FIG. 1, along the plane defined by parallel lines A-A and B-B in FIG. 1. The cavity 102 is the circular open area within the housing 101 of the mixing device 100. The circle that bounds the cavity 102 is one wall 104 of the cavity. Also shown in cross section is the tangential opening 106, which provides fluid communication between the outside or exterior 105 of the mixing device 100 and the cavity 102. As shown by the arrow directed into the tangential opening 106 from outside of the mixing device 100, fluid enters into the first end 108 of the tangential opening 106, flows through the second end 110 of the tangential opening 106, and enters into the cavity 102. Cavitation bubbles 200, which are generally formed by flow of the fluid through the tangential opening 106 and into the cavity 102, are shown as open irregular circles in the cavity 102. Cavitation bubbles can also be formed by the existence of lower pressure in the cavity 102 as compared to the pressure in the tangential opening 106.

The location and direction by which fluid enters the cavity 102 is generally provided for by the location at which the tangential opening 106 intersects the wall 104 of the cavity 102, and the angle at which the tangential opening 106 intersects the wall 104 of the cavity 102. The location and angle of intersection of the tangential opening 106 with the cavity 102 may provide for formation of a vortex of the fluid in the cavity 102. The vortex of fluid can generally provide for the formation of cavitation bubbles 200 in the cavity 102. In one embodiment, the tangential opening 106 is configured in relation to the cavity 102 such that the cavitation bubbles 200 do not contact or minimally contact one or more walls 104 of the cavity 102. Such non-contact or minimal contact of cavitation bubbles 200 with the walls 104 of the cavity can provide for minimal erosion of the walls 104 of the cavity 102 by the cavitation bubbles 200.

In one embodiment, the tangential opening 106 can be substantially parallel with the wall 104 of the cavity 102 at the point at which the tangential opening 106 intersects the cavity 102. The circular arrows illustrate the direction of the vortex within the cavity 102. The cavitation bubbles 200 are shown to be generally located away from the wall 104 of the cavity 102. In another embodiment, the tangential opening 106 can be provided closer to the longitudinal axis of the cavity so long as it is not considered a radial opening.

Once fluid flows into the cavity 102, the fluid can then flow out of the cavity 102 through the exit opening 112. In the mixing device 100, the exit opening 112 of the cavity 102 may be sequentially: a) blocked or partially blocked, thereby impeding, inhibiting, partially impeding or partially inhibiting fluid flow through the exit opening 112, (i.e., closed position) and b) unblocked or partially unblocked, thereby allowing for flow or partial flow of fluid through the exit opening 112 and out of the cavity 102 (i.e., open position).

Blocking and unblocking of the exit opening 112 of the cavity 102 may be provided for in a variety of ways. For example, a surface may be positioned opposite the exit opening 112 of the cavity 102 (i.e., a closed position) and, so positioned, block or partially block the exit opening 112. The surface may also be positioned away from the exit opening 112 of the cavity 102 (i.e., in an open position) and, so positioned, unblock or partially unblock the exit opening 112. In one example, the surface is movable between the position opposite the exit opening 112 and the position away from the exit opening 112. Such a surface may be referred to as a "movable surface" 300. A movable surface 300 may have different embodiments. In one embodiment, the movable surface 300 can be by itself or part of a rotatable member or disk.

In another example, the mixing device 100 can be movable such that in one position, the exit opening 112 of the cavity 102 is positioned opposite a surface, providing for a closed position of the cavity 102 and, in another position the exit opening 112 of the cavity 102 is positioned away from the surface, providing for an open position of the cavity 102. As is described in more detail below, one embodiment of a mixing device 100 that is movable is a rotor. Also as described below, a surface providing for open and closed positions of the cavities 102 may be provided by a stator.

Figure 3A:
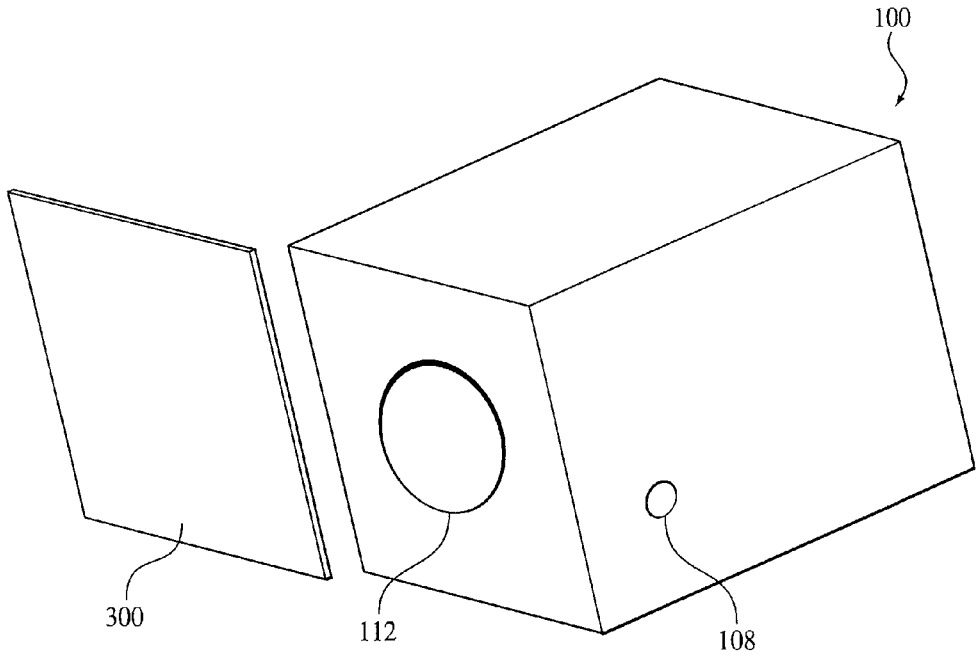
FIG. 3A is a perspective view of one embodiment of a mixing device 100 with a movable surface positioned such that the cavity is in the open position.

FIG. 3A is a perspective view of one embodiment of a mixing device 100 with a movable surface 300 positioned such that the cavity 102 is in the open position. In this particular embodiment, the movable surface is shown as a plane. In other embodiments, the movable surface 300 may be of a variety of other shapes. As illustrated, the movable surface 300 can be positioned away from the exit opening 112 such that fluid present in the cavity 102 can be flowable or partially flowable through the exit opening 112 and out of the cavity 102.

Figure 3B:
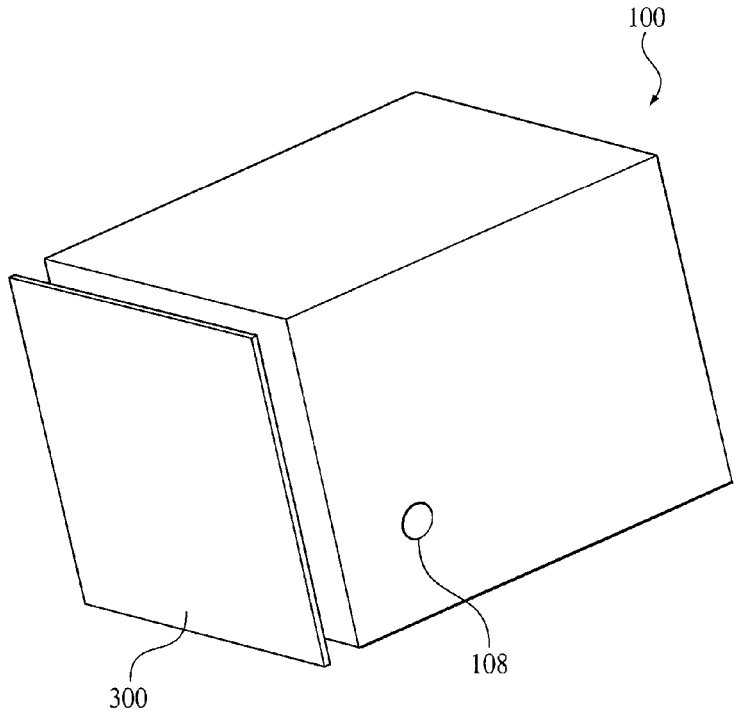
FIG. 3B is a perspective view of one embodiment of a mixing device 100 with a movable surface positioned such that the cavity is in the closed position.

FIG. 3B is a perspective view of one embodiment of a mixing device 100 with a movable surface 300 positioned such that the cavity 102 is in the closed position. As illustrated, the movable surface 300 can be positioned substantially opposite the exit opening 112 such that fluid present in the cavity 102 is inhibited or partially inhibited from flowing through the exit opening 112 and out of the cavity 102.

Intermittent blocking and unblocking of the exit opening 112 of the cavity 102, providing for the closed and open positions of the cavity 102, respectively, generally provides for high-shear mixing of fluid in the mixing device 100 due to a continuous cycle of formation and collapse of cavitation bubbles 200. In one embodiment, cavitation bubbles 200 may be present when the cavity 102 is in the open position. In the closed position, the pressure in the cavity 102 increased thereby causing the cavitation bubbles 200 located in the cavity 102 to collapse. Generally, the spacing between the exit opening 112 of the cavity 102 and the surface that blocks the exit opening 112 and impedes fluid flow out of the cavity 102, is sufficient to provide the pressure increase that causes collapse of the cavitation bubbles 200. Generally, such spacing provides for a pressure increase in the fluid of at least 1.4 pounds per square inch (psi) or at least above the saturated vapor pressure of the fluid being processed. Subsequent unblocking of the exit opening 112 of the cavity 102 causes a decrease in the pressure in the fluid and allows for formation of cavitation bubbles 200. One such cycle of formation and collapse of cavitation bubbles is shown in FIGS. 4A and 4B.

Figure 4A:
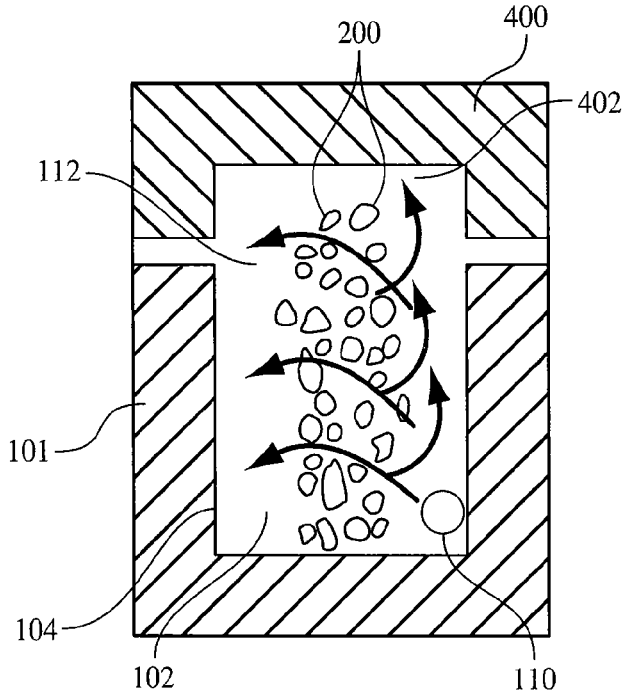
FIG. 4A is a cross-sectional view of one embodiment of a cavity 102 in the open position.

FIG. 4A is a cross-sectional view of one embodiment of a cavity 102 in the open position. In addition to the cavity 102, the wall 104 of the cavity 102 and the surrounding solid portion 101 of the mixing device 100 is shown. The second end 110 of the tangential opening 106 is shown entering the cavity 102 generally parallel to the wall 104 of the cavity 102. Cavitation bubbles 200 are illustrated within the cavity 102, generally located away from the wall 104 of the cavity 102. The direction of the vortex within the cavity 102 is shown by the circular arrows in the cavity 102. Also illustrated is the exit opening 112 of the cavity 102 and a surface 400 that is positioned opposite the exit opening 112. The surface 400 has a cutout or recess 402 that provides for flow or partial flow of the fluid through the exit opening 112 and out of the cavity 102. In the illustrated embodiment, the recess 402 provides a channel for fluid flow which is perpendicular to the plane of the figure.

Figure 4B:
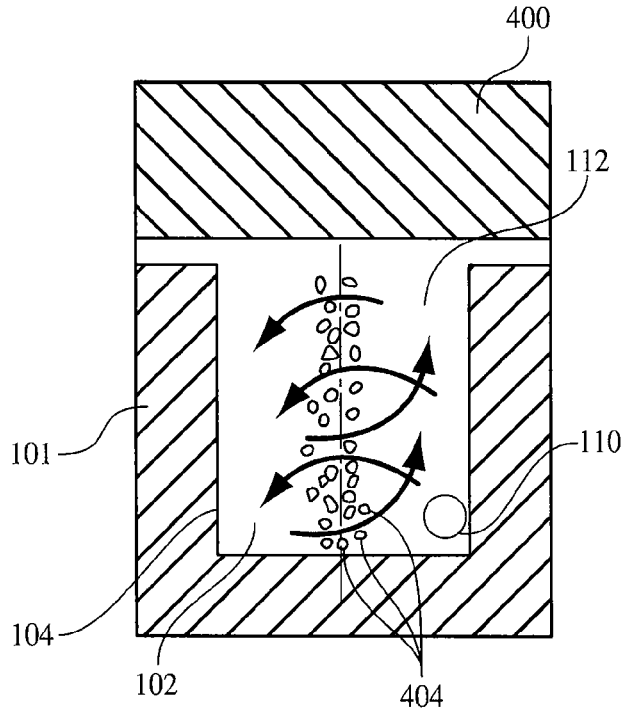
FIG. 4B is a cross-sectional view of one embodiment of a cavity 102 in the closed position.

FIG. 4B is a cross-sectional view of one embodiment of a cavity 102 in the closed position. FIG. 4B is similar to FIG. 4A except that the surface 400, which is also positioned opposite the exit opening 112 of the cavity 102, does not have a recess 402. So positioned, the surface 400 causes impediment or partial impediment of fluid flow through the exit opening 112 and out of the cavity 102. The impediment or partial impediment of fluid flow out of the cavity 112 causes an increase in the pressure of the fluid within the cavity 102. The pressure increase causes collapse or partial collapse of all or some of the cavitation bubbles 200 in the cavity 102. The collapsed cavitation bubbles 404 are illustrated as filled circles in FIG. 4B.

In operation of the mixing device 100, there is a force, generally a continuous force, directing fluid to flow into the cavity 102 via the tangential opening 106. In one example, such a force is supplied by a pump. As the force directs fluid into the cavity 102, the cavity alternates between the open and closed positions. In so alternating, there is generally a continuous cycling between: i) the presence of cavitation bubbles 200 in the cavity 102, ii) an increase in the pressure of the fluid in the cavity 102, iii) collapse of the cavitation bubbles 200, and iv) fluid flow out of the cavity 102.

The high-shear mixing produced by continuous cycling of the mixing device 100, as described above, can be controlled or regulated. Generally, control or regulation of the mixing is provided for by controlling one or both of formation of the cavitation bubbles 200 and collapse of the cavitation bubbles 200. Formation and/or collapse of the cavitation bubbles 200 is controllable by a number of factors. For example, the rate at which the fluid is caused to enter into the cavity 102, the width or diameter of the tangential opening 106, the volume of the cavity 102, the time the cavity 102 is in the closed position and in the open position, the rate at which the cavity 102 cycles between the closed and open positions, as well as other factors.

In another embodiment, one or more mixing devices are part of a single, first device. In one embodiment, the first device can be a rotor which rotates about an axis of rotation. In one embodiment, the rotor is positioned opposite a second device. In one embodiment, the second device is a stator. When the rotor is positioned opposite the stator, exit openings of cavities can be generally proximate to one or more surfaces that are part of the stator. When the rotor rotates about its axis of rotation, the exit openings can alternately be blocked and unblocked based on their proximity to the one or more surfaces of the stator.

In another embodiment, the single, first device that contains one or more mixing devices is not rotatable. In one embodiment, the first device can be positioned opposite a second device. In this embodiment, the second device is rotatable and, when rotated, the second device provides for alternately blocking and unblocking of exit openings of cavities that are part of the first device.

In still another embodiment, the single device that contains one or more mixing devices and the oppositely-positioned second device are both rotatable. When both devices are rotated, exit openings of cavities 102 in the first device are alternately blocked and unblocked, providing for closed and open positions of the cavities, respectively.

Figure 5:
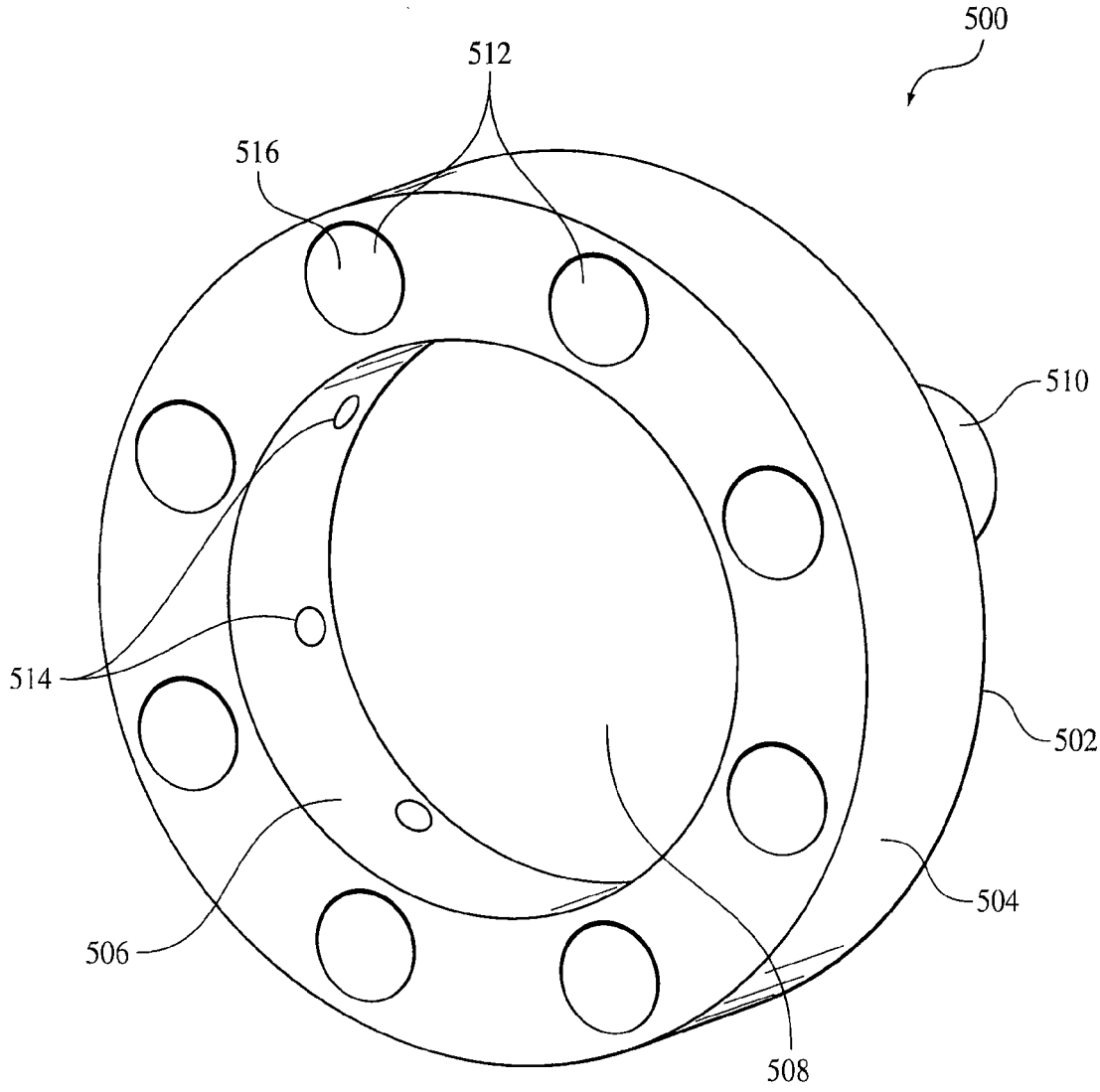
FIG. 5 is a perspective view of one embodiment of a rotor 500 for use in a device for generating vortex cavitation in a fluid.

FIG. 5 is a perspective view of one embodiment of a rotor 500 for use in a device for generating vortex cavitation in a fluid. In this embodiment, the rotor 500 can have a base portion 502. The base portion 502 can be configured in the shape of a circular disk as illustrated or can be configured in other shapes. Extending from the base portion 502 of the rotor 500 can be a peripheral portion 504, which may be referred to as a raised annular portion. The peripheral portion 504 can generally be in the shape of a ring, which may be referred to as a raised annular portion and has an interior surface 506 on the interior of the peripheral portion 504. The general area bounded by the interior surface 506 of the peripheral portion 504 and the base portion 502 can define an inlet space 508. In the illustrated embodiment, the inlet space 508 is substantially cylindrical in shape with an axis substantially aligned with the axis of rotation of the rotor, as described below. In one embodiment, the fluid initially enters the rotor 500 via the inlet space 508.

Attached to the rear of the base portion 502 may be a shaft 510. The shaft 510 is designed to facilitate rotation of the rotor 500. The rotor 500 can be rotated around an axis defined by a longitudinal line running along the length of the shaft 510, through its center. Such an axis can also be referred to as an axis of rotation of the rotor 500.

A plurality of cavities 512 may be disposed within the peripheral portion 504 of the rotor 500. In the embodiment illustrated in FIG. 5, the cavities 512 are generally cylindrical in shape and have an axis parallel or substantially parallel to the axis of rotation of the rotor. It will be appreciated that the cavities may take the form of other shapes. In one embodiment, the axes of the cylindrical cavities 512 are spaced apart from the axis of rotation of the rotor 500.

In one embodiment, the peripheral portion 504 includes a plurality of tangential orifices 514 that extend between the interior surface 506 and each respective cavity 512.

In the embodiment shown in FIG. 5, each tangential orifice 514 extends from the interior surface 506 of the peripheral portion 504 of the rotor 500 to each cavity 512 and has an axis substantially perpendicular to the axis of rotation of the rotor 500. Each tangential orifice 514 can provide fluid communication between the inlet space 508 and each cavity 512.

In one embodiment, fluid entering into the rotor 500 at the inlet space 508 can be directed into the tangential orifices 514 and then into the cavities 512. Generally, the force providing for entry of the fluid into the tangential orifices 514 is a centrifugal pumping force provided by rotation of the rotor 500 about its axis of rotation.

In one embodiment, each cavity 512 includes an opening 516 to permit the fluid to exit the cavity 512.

Figure 6:
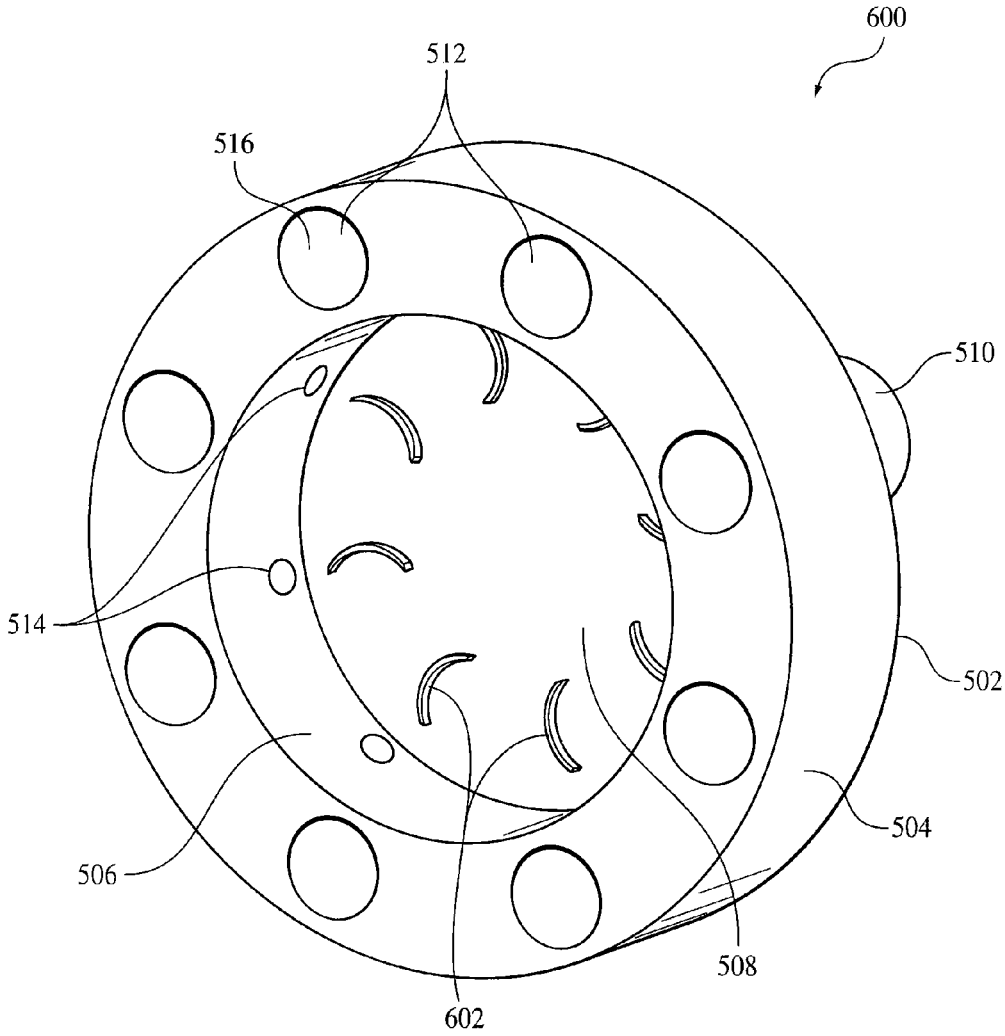
FIG. 6 is a perspective view of another embodiment of a rotor 600 for use in a device for generating vortex cavitation in a fluid.

FIG. 6 is a perspective view of another embodiment of a rotor 600 for use in a device for generating vortex cavitation in a fluid. In the illustrated embodiment, a series of vanes 602 can be provided in a bottom wall 604 of the cavity 512 direction of fluid from the inlet space 508 into the tangential orifices 514 as the rotor 600 rotates.

Figure 7:
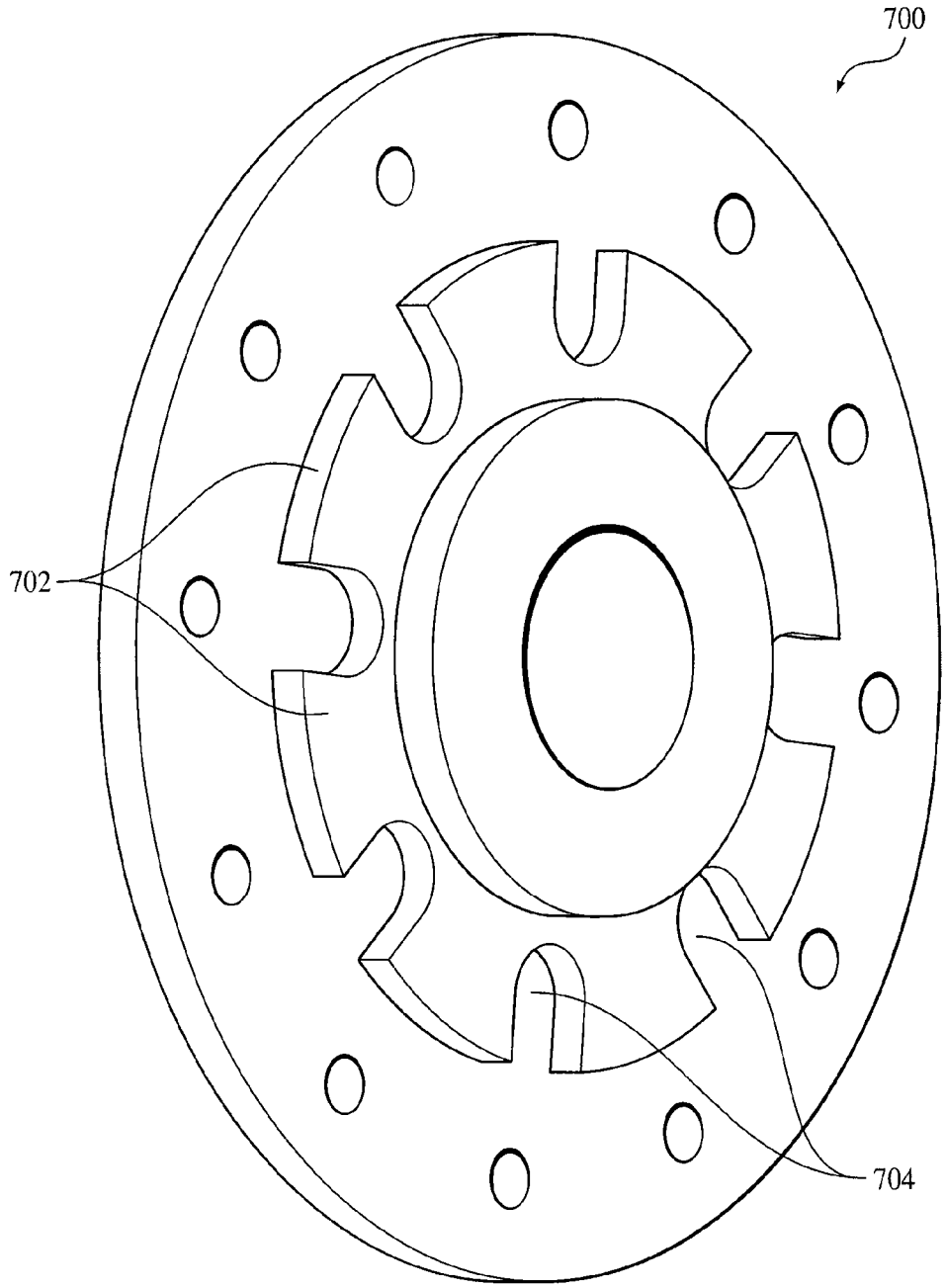
FIG. 7 is a perspective view of one embodiment of a stator 700 for use in a device for generating vortex cavitation in a fluid.

FIG. 7 is a perspective view of one embodiment of a stator 700 for use in a device for generation vortex cavitation in a fluid. As described above, the stator 700 can include a surface or surfaces that is configured to block or impede fluid flow from exiting each cavity 512 through its exit opening 516 when positioned opposite a rotor and, alternately, is configured to not block or impede fluid flow out of the cavities 512 through the exit openings 516. In the illustrated embodiment, the stator 700 has a series of alternating tabs 702 and recesses 704, which together provide a discontinuous surface. The discontinuous surface, when positioned opposite a rotating rotor, provide for alternate blocking and unblocking of the exit openings 516 of the cavities 512, as will be described in more detail below. Other configurations of the stator 700 which provide such blocking and unblocking are obviously possible.

Figure 8:
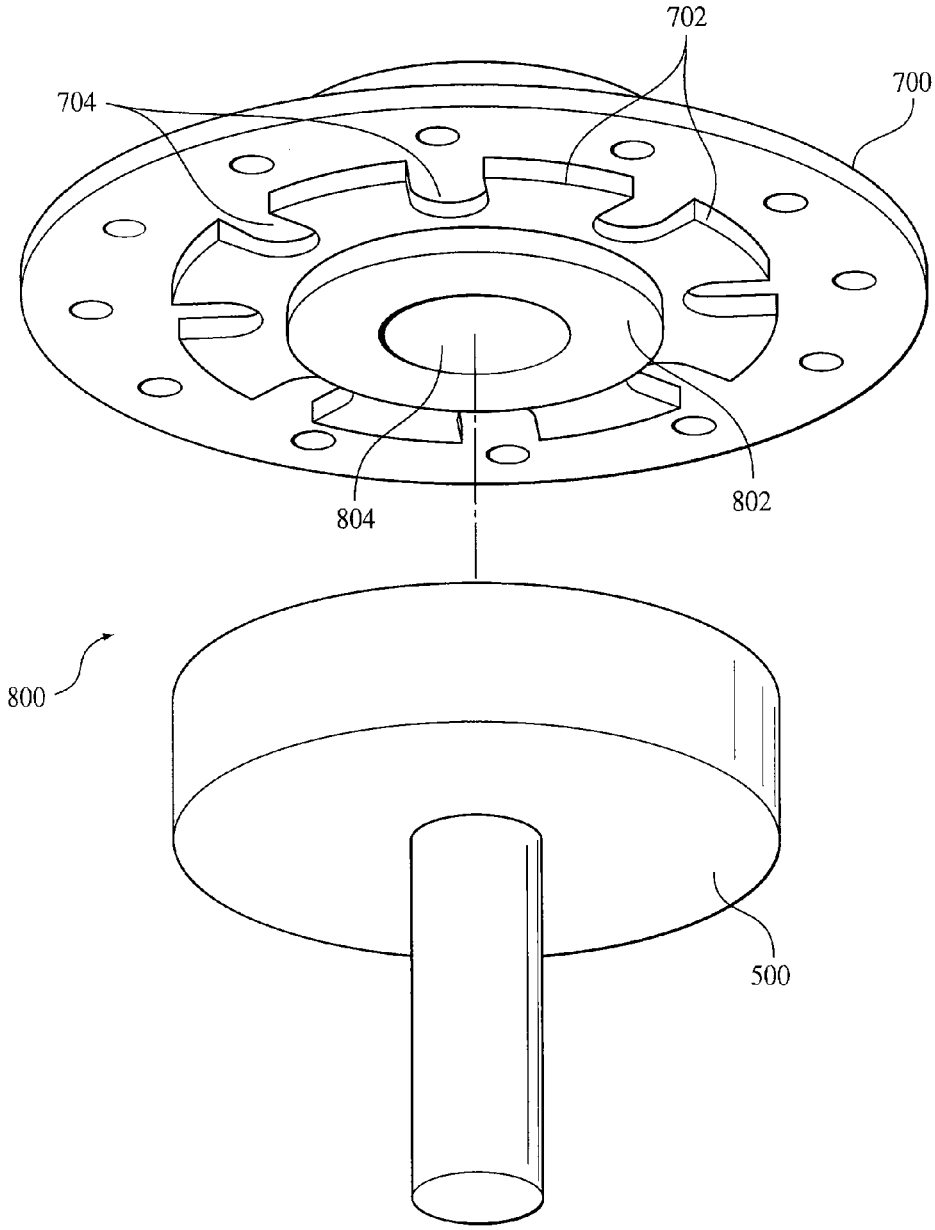
FIG. 8 is an exploded, perspective view of one embodiment of a device 800 for generating vortex cavitation in a fluid.
Figure 9:
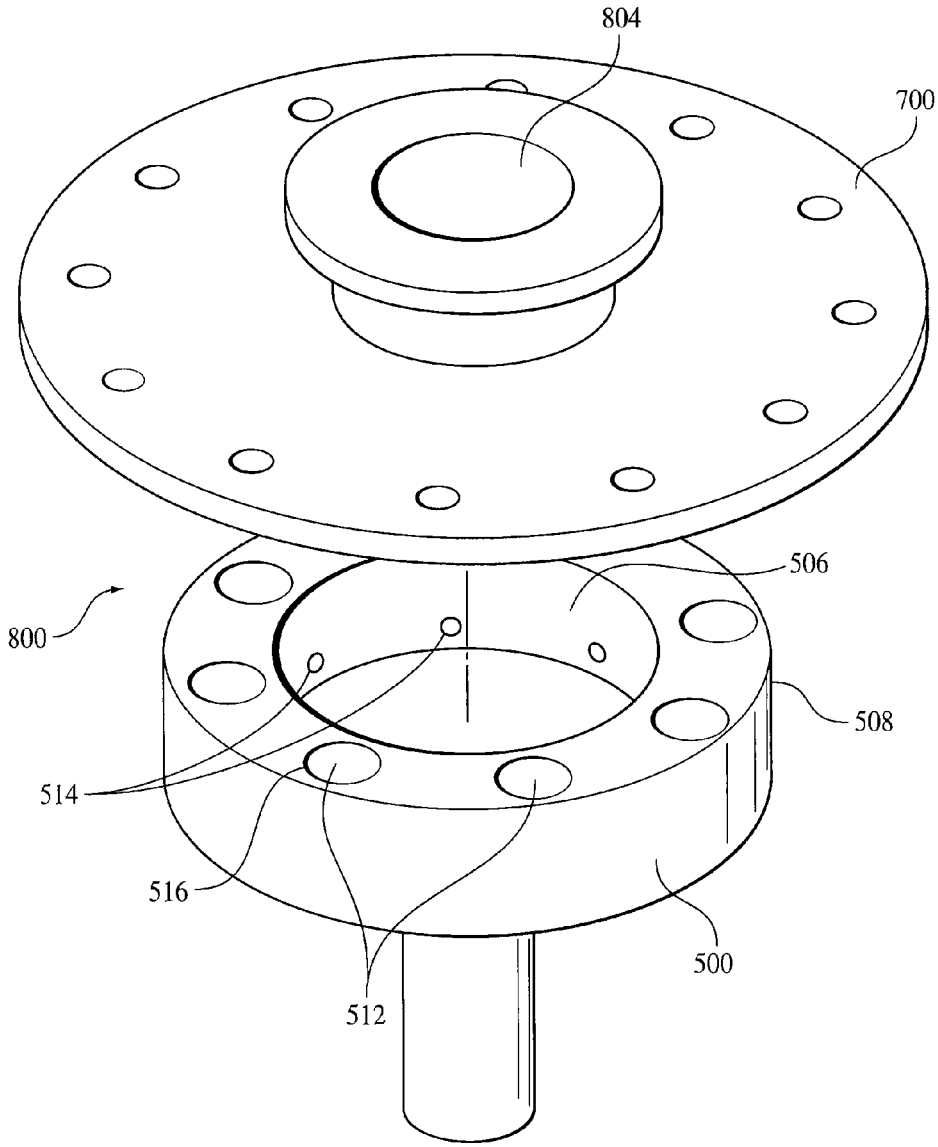
FIG. 9 is another exploded, perspective view of an embodiment of the device 800 for generating vortex cavitation in a fluid.

FIGS. 8 and 9 are exploded, perspective views of an embodiment of a device 800 for generating vortex cavitation in a fluid. In the illustrated embodiment, the device 800 for generating vortex cavitation in a fluid can include a rotor 500 and a stator 700. FIGS. 8 and 9 illustrate the positional arrangement of the rotor 500 with respect to the stator 700. So positioned, when the rotor 500 and stator 700 are brought closer to one another, an alignment ring 802 of the stator 700 can fit into the inlet space 508 of the rotor 500 and provide for correct positioning and alignment of the rotor 500 and stator 700 with respect to one another. So positioned, the tabs 702 and cutouts 704 of the stator 700 are in close proximity to the exit openings 516 of the cavities 512 of the rotor 500. When positioned in this way, the rotor 500 and stator 700 are said to be positioned "opposite" to one another.

In operation, fluid can enter into the device 800 through the inlet 804 as illustrated in FIG. 9. The fluid can then flow into the inlet space 508 of the rotor 500. In one embodiment, the rotor 500 can be rotated about its axis of rotation. This rotation can cause a centrifugal force or centrifugal pumping force causing the fluid to move toward the interior surface 506 of the rotor 500 and enter into the tangential openings 514 of the rotor 500. The fluid can then flow through the tangential openings 514 and into the cavities 512. As the fluid exits the tangential openings 514 and enters the cavities 512, cavitation bubbles can be formed in the fluid. Due to rotation of the rotor 500, the cavities 512 can alternate between the open and closed positions, based on the alignment of the exit openings 516 of the cavities 512 with the discontinuous surface of the stator 700, which comprises the tabs 702 and cutouts 704. The alternation between open and closed positions of the cavities 512 is described in more detail below.

Figure 10A:
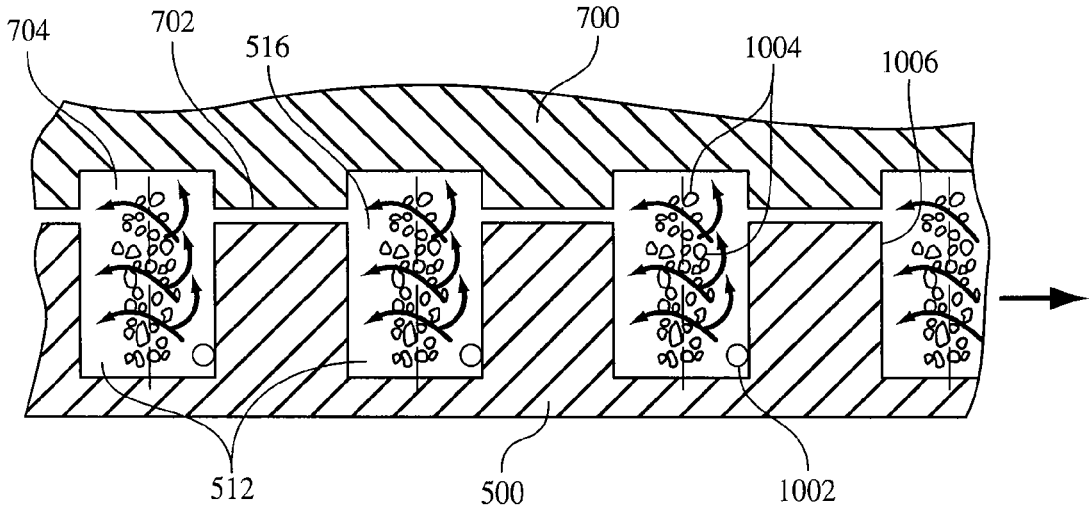
FIG. 10A is a cross-sectional view of one embodiment of a plurality of cavities 512 in the open position.

FIG. 10A is a cross-sectional view of one embodiment of a plurality of cavities 512 in the rotor 500 in the open position with respect to the stator 700. The cavities 512, the tangential openings 514, and the exit openings 516 are shown as part of the rotor 500. The tabs 702 and cutouts 704 are shown as part of the stator 700. Similar to the description of FIG. 4A, cavitation bubbles 1004 are illustrated within the cavities 512, generally located away from the walls 1006 of the cavities 512 caused by the introduction of fluid into the cavities 512 via the tangential opening 514. There may be a vortex within the cavities 512. The direction of the vortex within the cavities 512 is shown by the circular arrows in the cavities 512. Also illustrated are the exit openings 516 of the cavities 512, and cutouts 704 that are positioned opposite the exit openings 516. So positioned, the cutouts 704 are aligned with the exit openings 516. The cutouts 704 provide for flow or partial flow of the fluid through the exit openings 516 and out of the cavities 512.

Figure 10B:
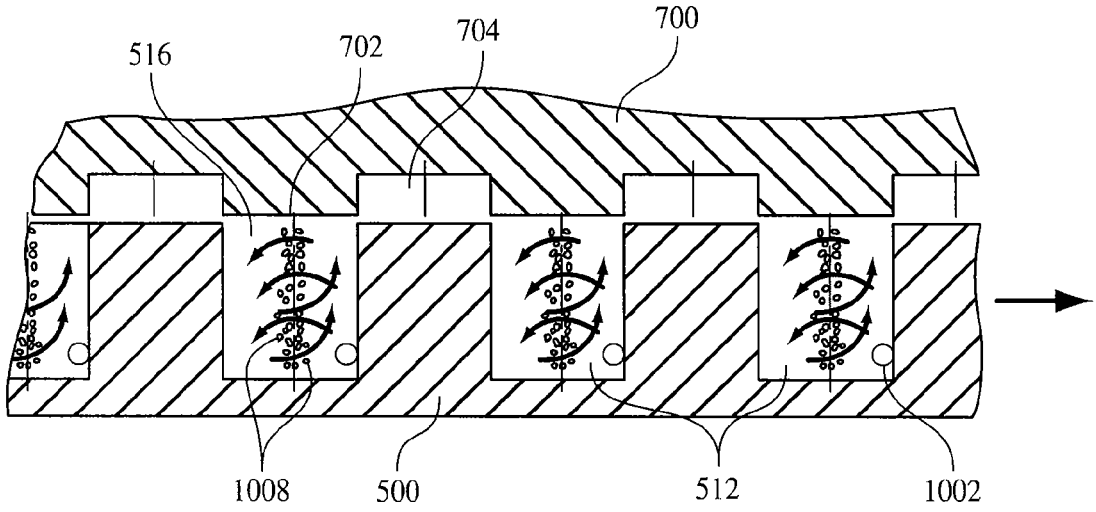
FIG. 10B is a cross-sectional view of one embodiment of a plurality of cavities 512 in the closed position.

FIG. 10B is a cross-sectional view of one embodiment of a plurality of cavities 512 in the rotor 500 in the closed position. In FIG. 10B, as compared to FIG. 10A, the rotor 500 has rotated with respect to the stator 700 such that the cavities 512 are in the closed position. As illustrated, the tabs 702 are positioned opposite the exit openings 516. So positioned, the tabs 704 are aligned with the exit openings 516 and can cause impediment or partial impediment of fluid flow through the exit openings 516 and out of the cavities 512. The impediment or partial impediment of fluid flow out of the cavities 512 causes an increase in the pressure of the fluid within the cavities 512. The pressure increase causes collapse or partial collapse of all or some of the cavitation bubbles 1004 in the cavities 512. The collapsed cavitation bubbles 1008 are illustrated as filled circles in FIG. 10B.

Continuous rotation of the rotor 500 in relation to the stator 700 can provide for constant or near-constant creation of cavitation bubbles 1004, and their collapse and outflow from the cavities 512. The rate at which cavitation bubbles 1004 are formed, as well as the rate at which the cavitation bubbles 1004 collapse, can be controllable. For example, control of the cavitation process can be provided by altering the rate at which the rotor 500 is rotated. Also, rotation of the rotor 500 at relatively higher speeds can result in an increased rate of formation, collapse, or formation and collapse of cavitation bubbles 1004, and formation of relatively higher pressures and/or temperatures. In contrast, rotation of the rotor 500 at relatively lower speeds can result in a decreased rate of formation, collapse, or formation and collapse of cavitation bubbles 1004, and relatively lower pressures and/or temperatures.

Generally, the rate at which the rotor 500 is rotated can control the degree of the centrifugal pumping force generated and may control a variety of factors, including the rate at which fluid enters the inlet space 508, the rate at which fluid enters the tangential openings 514, the pressure in the cavities 512, and the like.

Additionally, control of the cavitation process may be provided by the dimensions of the rotor 500 and/or the stator 700, the placement of the rotor 500 with respect to the stator 700, and the like. With respect to the rotor 700, for example, different diameters of a rotor 500 may provide different degrees of cavitation. In another example, a greater distance between a first end (which is adjacent the interior surface 506) of the tangential opening 514 and the axis of rotation of the rotor 500 can increase the pressures and/or temperatures generated by the cavitation process. Likewise, a greater distance between a second end (which is adjacent he tangential opening 514) of the tangential opening 514 and the axis of rotation of the rotor 500 can also increase the pressures and/or temperatures generated by the cavitation process.

The ability to control cavitation, through variability of the factors described above, can allow the cavitation process to be performed at pressures and/or temperatures that are advantageous to the particular application.

Figure 11:
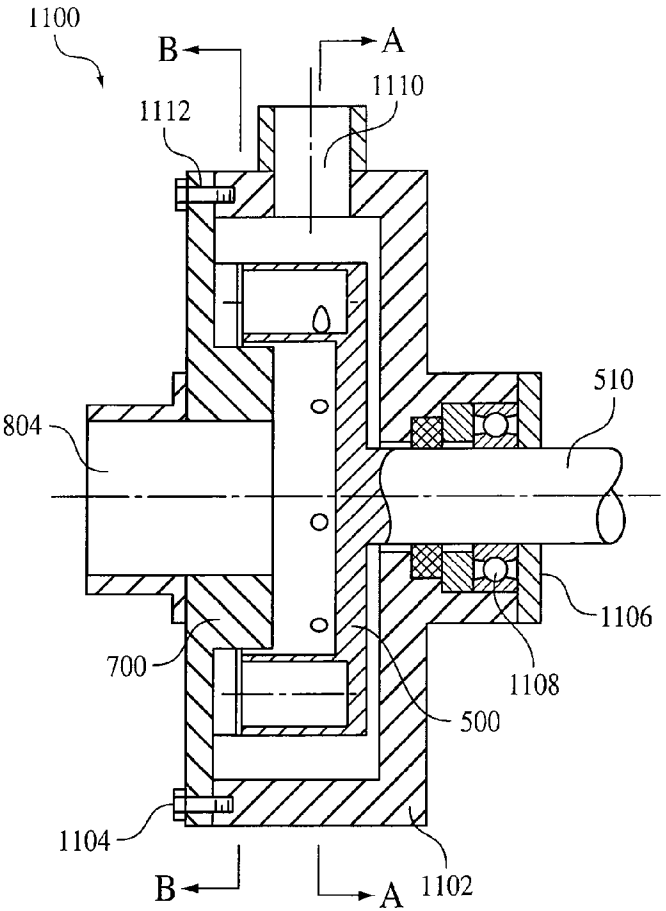
FIG. 11 is a longitudinal cross-sectional view of one embodiment of a mixing device 1100.

FIG. 11 is a longitudinal cross-sectional view of one embodiment of a mixing device 1100. In the illustrated embodiment, the mixing device 1100 includes a rotor 500, stator 700 and a housing 1102. In the illustrated embodiment, the stator 700 is attached to the housing 1102 using screws 1104 positioned through the attachment holes 1112 of the stator 700. In this embodiment of the mixing device 1100, the rotor 500 and stator 700 can be disposed within the housing 1100. In another embodiment, the stator 700 may be integral with the housing.

FIG. 11 illustrates the rotor 500 and stator 700 positioned opposite one another. In the illustrated embodiment, the housing 1100 can provide a shaft opening 1106, through which the shaft 510 of the rotor 500 is disposed. This can provide the correct positioning of the rotor 500 in the mixing device 1100. The housing 1100 may also provide bearings 1108 to facilitate rotation of the rotor 500 by the shaft 510. In the illustrated embodiment, an outlet 1110 is disposed in the housing 1100. The outlet 1110 provides for exit of fluid from the mixing device 1100.

In operation, fluid can enter the mixing device 1100 through the inlet 804 of the stator 700. The device generally functions as described in relation to FIGS. 9 and 10. When fluid exits through the exit openings 516 of the cavities 512, as described in relation to FIG. 10A, the fluid exits the mixing device 1100 through the outlet 1110.

Figure 12:
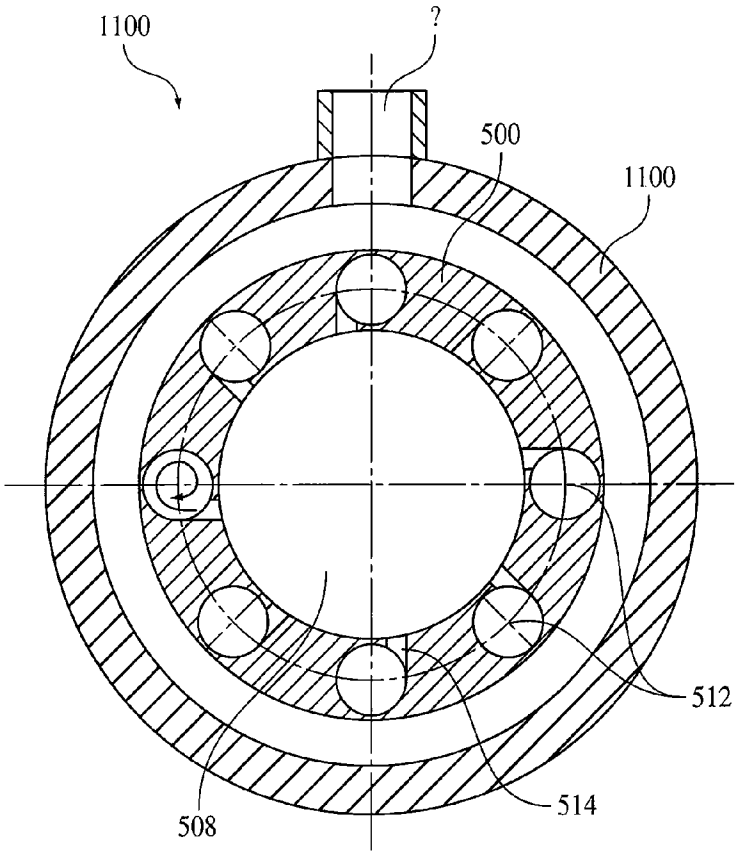
FIG. 12 is another cross-sectional view of the mixing device 1100 shown in FIG. 11, along the plane defined by line A-A in FIG. 11.

FIG. 12 is a cross-sectional view of the mixing device 1100 shown in FIG. 11, along the plane defined by line A-A in FIG. 11. This view shows the rotor 500 assembled within the housing 1100. The outlet 1110 is visible. The tangential openings 514, providing fluid communication between the inlet space 508 and the cavities 512, are also illustrated.

Figure 13:
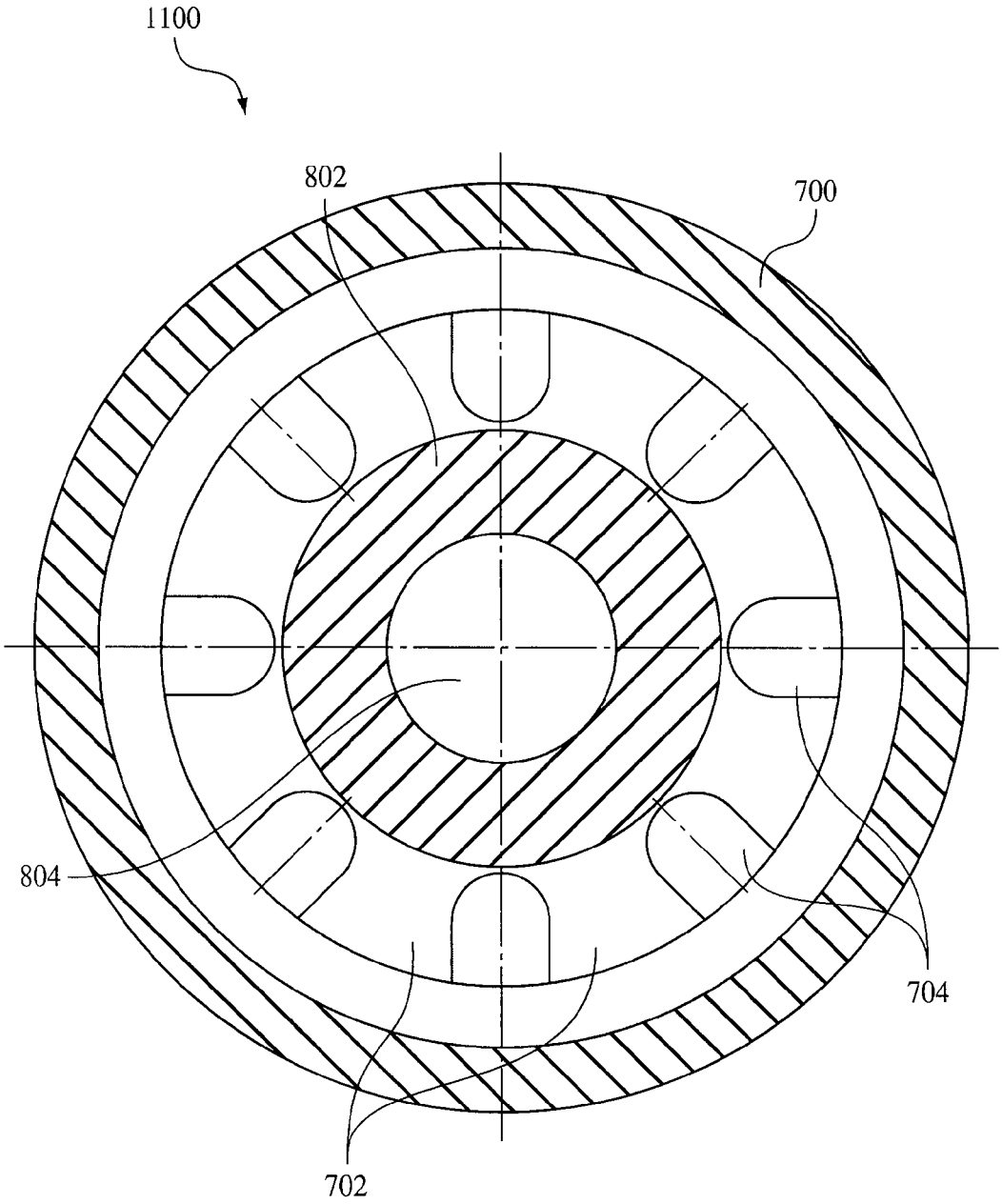
FIG. 13 is still another cross-sectional view of the mixing device 1100 shown in FIG. 11, along the plane defined by line B-B in FIG. 11.

FIG. 13 is a cross-sectional view of a mixing device 1100 shown in FIG. 11, along the plane defined by line B-B in FIG. 11. This view shows a section of the stator 700. The tabs 702, cutouts 704, inlet hole 804 and alignment ring 802 is visible.

In an alternative embodiment, the cavities can be provided in the stator 700 and the rotor 500 can play the role of the pump and the mechanism to facilitate opening and closing the cavities.

In another embodiment, a method of creating cavitation bubbles in a fluid is provided. In one embodiment, a fluid is introduced into one or more cavities to form cavitation bubbles therein. Introduction of the fluid into the cavity is tangential, which facilitates vortex formation within the cavity, as discussed earlier. Generally, the vortex contributes to formation of the cavitation bubbles. The vortex may contribute to a pressure drop in the fluid sufficient for formation of cavitation bubbles. Generally, the pressure drop is present in or near the middle of the vortex, or in a "core zone" of the vortex, facilitating formation of cavitation bubbles in that location. The method additionally provides for collapse of the cavitation bubbles, by closing the one or more cavities, providing for a pressure increase in the fluid and collapse of the cavitation bubbles. The method also may provide for opening the one or more cavities to permit the fluid to exit the one or more cavities.

In another embodiment, a product made by the above described method is provided. Generally, the product may be a mixture of one or more liquids, gases or solids. The product also may be a reaction product of one or more liquids, gases or solids.

The above description has referred to the preferred embodiments and selected alternate embodiments. Modifications and alterations will become apparent to persons skilled in the art upon reading and understanding the preceding detailed description. It is intended that the embodiments described herein be construed as including all such alterations and modifications insofar as they come within the scope of the appended claims or the equivalence thereof.

I claim:

1. A mixing device comprising:

a housing including at least one cavity and at least one tangential opening, the cavity having a closed end and an open end through which fluid is permitted to exit, the tangential opening being disposed in the housing such that it is in fluid communication with the cavity at one end and configured to permit fluid to flow to the cavity and thereby form cavitation bubbles in the fluid; and a rotatable disk positioned adjacent to the open end of the cavity and configured to interact with the open end of the cavity to allow the cavity to alternate between open and closed positions, where:

in the closed position, pressure increases in the cavity and causes the cavitation bubbles in the fluid to collapse and thereby create high-shear mixing; and in the open position, at least a portion of the fluid exits the cavity and pressure decreases in the cavity permitting additional cavitation bubbles to be formed in the fluid in the cavity.

2. The mixing device of claim 1, wherein:

the closed position is provided by blocking or partially blocking the open end of the cavity; and the open position is provided by unblocking or partially unblocking the open end of the cavity.

3. The mixing device of claim 1, wherein fluid flow to the cavity additionally creates a vortex in the cavity.

4. The mixing device of claim 1, wherein the housing further includes an inlet configured to permit the fluid to enter the housing, the inlet being in fluid communication with the other end of the tangential opening to permit the fluid to flow from the inlet to the cavity.

5. The mixing device of claim 1, wherein rotation of the housing creates centrifugal forces in the fluid such that the fluid is forced through the tangential opening and into the cavity.

6. The mixing device of claim 5, wherein rotation of the housing in relation to the rotatable disk provides for alternation between open and closed positions of the cavity.

7. The mixing device of claim 6, wherein, in the closed position of the cavity, the spacing between the rotatable disk and housing is sufficient to provide the pressure increase that causes collapse of the cavitation bubbles.

8. The mixing device of claim 7, wherein the pressure increase is at least above the saturated vapor pressure of the fluid.

9. The mixing device of claim 1, wherein the rotatable disk is movable relative to the open end of the cavity to provide for alternation between open and closed positions of the cavity.

* * * * *